United States Patent [19]

Doery

[11] Patent Number: 4,819,021

[45] Date of Patent: Apr. 4, 1989

[54] COPIER ON-LINE VARIABLE TAB CUTTER

[75] Inventor: Michael S. Doery, Rochester, N.Y.

[73] Assignee: Xerox Corporation, Stamford, Conn.

[21] Appl. No.: 130,868

[22] Filed: Dec. 10, 1987

[51] Int. Cl.[4] ..... G03G 15/00

[52] U.S. Cl. ..... 355/13; 355/3 SH; 355/3 R; 83/451; 83/438; 83/311

[58] Field of Search ..... 355/13, 3 R, 3 SH, 14 SH, 355/45; 83/70, 72, 205, 311, 333, 334, 430, 438, 451, 425.3, 487, 500, 501, 553, 917

[56] References Cited

U.S. PATENT DOCUMENTS

| | | | |
|---|---|---|---|
| 1,274,623 | 8/1918 | Spiegel . | |
| 2,142,799 | 1/1939 | Nicholas | 164/70 |
| 2,725,002 | 11/1955 | Battersby | 93/93 |
| 2,936,664 | 5/1960 | Myers | 83/487 |
| 3,722,999 | 3/1973 | Cunha et al. | 355/45 |
| 3,727,499 | 4/1973 | Boston | 83/205 |
| 3,769,868 | 3/1976 | Hornung | 83/311 X |
| 3,943,809 | 3/1976 | Schoppee | 83/311 |
| 4,046,470 | 9/1977 | Yamamoto | 355/13 |
| 4,058,037 | 11/1977 | Tashiro et al. | 83/70 |
| 4,200,017 | 4/1980 | Fein | 83/333 |
| 4,245,534 | 1/1981 | Van Cleave | 83/500 |
| 4,248,523 | 2/1981 | Doi et al. | 355/13 |
| 4,362,076 | 12/1982 | Sasaki et al. | 355/13 X |
| 4,559,855 | 12/1985 | Schieck | 83/425.3 |
| 4,597,521 | 7/1986 | Wilson | 228/160 |

FOREIGN PATENT DOCUMENTS

| | | |
|---|---|---|
| 0208324 | 10/1986 | European Pat. Off. . |
| 55-14045 | 4/1980 | Japan . |
| 59-7665 | 1/1984 | Japan . |
| 59-135454 | 8/1984 | Japan . |
| 59-135455 | 8/1984 | Japan . |

*Primary Examiner*—A. C. Prescott

[57] ABSTRACT

In a copier, automatically providing tabbed sheets in the output of the copy sheets of the copier, with an integral, on-line, copy sheet tab cutting system. Selectably varying the tab cutting position and cut tab size provides sequentially varied tabs. A selected tab may be cut on any selected sheet being fed through the regular copy sheet (paper) path of a xerographic or other copier or printer. This may be done by temporarily stopping and registering the leading edge of the selected sheet, and then shear cutting off the untabbed areas of the trailing edge of the sheet by moving an shear cutting assembly transversely across the direction of movement of the copy sheet path of the copier upstream of the lead edge registration position at slightly less than the sheet width distance, and providing irregular width cutting of the sheet (non-cutting of the tab area). The latter may be provided by a tab interruption or offset of mating tab cutting shear wheels on the shear cutting assembly, and this may be variably repositioned by indexed rotation of the shear wheels to change the tab cutting position.

12 Claims, 3 Drawing Sheets

COPIER ON-LINE VARIABLE TAB CUTTER

The present invention relates to the automatic providing of tabbed sheets in the output of copy sheets of a copier, with an integral, on-line, copy sheet tab cutting system. Also disclosed is the capability of varying the tab cutting to provide varied tabs. A selected tab may be cut on a selected sheet being fed through the regular copy sheet (paper) path of a xerographic or other photocopier or printer. The tab cutting system here does not interfere with or interrupt normal copying operations.

Along with the increases in speed and capabilities of modern copiers, there has been provided collated output in collated copy sets, and the availability of programming special insert sheets at selected positions in the output copy set. The providing of separating tab sheets within and/or as the covers of the collated copy sheet sets, especially with printed tabs printed by the copier itself, has become a desirable feature therefore. An example of a patent publication relating to copier tab printing is Eastman Kodak EPO No. 0 208 324 published Jan. 14, 1987, based on U.S. Ser. No. 754,312 filed July 12, 1985. On-line finishing of the outputted collated copy sets by stapling, stitching or glue binding is another known feature. Examples of these and other collated output system features and prior art references are disclosed in copending Xerox Corporation U.S. Ser. No. 098,096 filed Sept. 17, 1987 by James E. Britt, et al.

However, heretofore the providing of tab sheets for the collated copy sheet sets has apparently required the use of precut, pre-tabbed, sheets. If variable position tabs are required, these must be provided by preloading all the different required pre-tabbed sheets into a dedicated (separate) copier paper feed tray, in a prearranged order, or using several different trays. Furthermore, if a copier or document feeder jam occurs in such a special job run, job recovery is difficult without mixing up or interrupting the desired order of the tabbed sheets, or printing the wrong titles on the wrong tabs, or not at all, or the like.

Although various copy sheet slitters or cutters have been disclosed for cutting up copy sheets in or from a copier, for many years, as disclosed in Xerox Corporation U.S. Pat. No. 4,559,855 issued Dec. 24, 1985 to R. A. Schieck and various references cited therein, and U.S. Pat. No. 4,058,037 issued Nov. 15, 1977 to S. Tashiro et al., the providing of either on-line tab cutting in a copier, or a cutter suitable therefore, does not seem to have been suggested in the copier art, as far as is presently known to the inventor.

Likewise the providing of variable tab cutters and other cutters in general for various other applications has been known for many years without apparently having been successfully incorporated into a copier for tab cutting, as far as is presently known to the inventor. Some examples of tab cutters or other shear cutters in general are shown in Japanese laid open patent application Nos. 59-135,454 and 59-135,455, on cutting movie film tabs; and Japanese laid open patent application nos. 59-7665 and 55-140454; and U.S. Pat. Nos. 2,725,002; 3,943,809; 1,274,623; 2,142,799; 2,936,664; 3,943,809; 4,200,017; 4,245,534; and 4,597,521.

The term "document" here refers to the sheet (original or previous copy) or electronic image being copied in the copier onto the outputted "copy sheet", or "copy". Related plural sheets of documents or copies are referred to as a "set". A "simplex" document or copy sheet is one having an image and "page" on only one side or face of the sheet, whereas a "duplex" document or copy sheet has a "page", and normally an image, on both sides.

The present invention is particularly suitable for precollation copying, i.e. automatically plurally recirculated document set copying provided by a recirculating document handling system or "RDH", or electronic page order input. However, it also has applicability to nonprecollation, or postcollation, copying, such as postcollation operation of an RDH or semiautomatic document handling (SADH), or a non-recirculating automatic document feeder (ADF), with or without a connecting multibin sorter.

Some examples of Xerox Corporation U.S. RDH patents are U.S. Pat. Nos. 4,459,013 issued July 10, 1984 to T. J. Hamlin et al; 4,278,344 issued July 14, 1981 to R. B. Sahay; and 4,579,444, 325 or 326. Some other examples of recirculating document handlers are disclosed in U.S. Pat. Nos. 4,076,408; 4,176,945; 4,428,667; 4,330,197; 4,466,733 and 4,544,148. An integral semiautomatic and computer form feeder (SADH/CFF), which may be an integral part of an RDH, as noted in Col. 2, paragraph 2, therein, is disclosed in U.S. Pat. No. 4,462,527. Various patents, such as U.S. Pat. No. 4,176,945 above, issued Dec. 4, 1979 to R. Holzhauser (Kodak) teach plural mode, e.g. RDH/SADH, document handlers.

The present invention overcomes various of the above-discussed and other problems, and provides various of the above-noted and other features and advantages.

A feature of the specific embodiment disclosed herein is to provide, in a copier providing a stream of copy sheets in a copy sheet path, the improvement comprising a sheet selecting and stopping means, for selecting a selected said output copy sheet to be tabbed, and for temporarily stopping said selected copy sheet within said copier at a tabbing registration position within said copier for tab cutting; and tab cutting means in said copier for cutting an edge of said selected copy sheet transversely of said output copy sheet path to form a selected tab on said selected copy sheet while said copy sheet is temporarily stopped by said sheet selecting and stopping means, and then releasing said tabbed copy sheet into said copy sheet path.

Further features provided by the system disclosed herein, individually or in combination, include those wherein said tab cutting means comprises rotatable slitting wheels mounted on a carriage movable transversely of said copy sheet path; said rotatable slitting wheels having mating cutting edges shaped to cut a tab in the copy sheet by rotation of said rotatable slitting wheels as said carriage is moved transversely of said copy sheet path, wherein said tab cutting means is selectably variably operable to form variable position and/or variable size tabs on said copy sheet, by changing the rotation of said rotatable slitting wheels; wherein said cutting edges have a tab shaped non-cutting position extending upsteam in said copy sheet path; wherein said tab cutting means is positioned downstream of said tabbing registration position in said copy sheet path by approximately the sheet width of said copy sheet to engage the trail edge of a copy sheet when the lead edge of a copy sheet is being temporarily stopped by said sheet selecting and stopping means, so that said rotatable slitting wheels cut off all but the selected tab area of the trail edge of the copy sheet when the lead edge of the copy sheet is being temporarily stopped by said sheet selecting and stopping means as said carriage is moved transversely of said output copy sheet path.

Further features provided by the system disclosed herein, individually or in combination, include, in a method of copying providing a stream of output copy sheets with tabbed insert sheets from a copy sheet path of a copier, the improvement comprising the steps of: selecting one said copy sheet at a time to be tabbed; and temporarily stopping the leading edge of the selected copy sheet in said copy sheet path at a tabbing registration position; and tab cutting the opposing, trailing, edge of said selected copy sheet transversely of said output copy sheet path to form a selected tab on the trailing edge of said selected copy sheet while said copy sheet is temporarily stopped; and then releasing said tabbed copy sheet into said copy sheet path again; and repeating said steps for subsequent selected copy sheets selected out of said stream of copy sheets, wherein said tab cutting comprises both moving and rotating a slitting wheel transversely of said copy sheet path, spaced from said tabbing registration position, said slitting wheel having a cutting edge shaped to cut a tab in the copy sheet by rotation of said slitting wheel as said slitting wheel is moved transversely of said copy sheet path; wherein said tab cutting is by a pair of mating irregular slitting wheels, and is selectably variably operable by variable rotation of said slitting wheels relative to said copy sheet to form variable position or variable size tabs on said copy sheet; and further including the step of punching binding holes in said selected copy sheet along the side of said selected copy sheet opposite from said tab cutting and substantially simultaneously with said tab cutting.

Some examples of various other prior art copiers with document handlers, and especially with control systems therefor, including document sheet detecting switches, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in this art, and in general, how to program and execute document handler and copier control functions and logic with conventional or simple software instructions for conventional microprocessors. This is taught by the above and other patents and various commercial copiers. Such software may vary depending on the particular function and particular microprocessor or microcomputer system utilized, of course, but will be available to or readily programmable by those skilled in the applicable arts without experimentation from either descriptions or prior knowledge of the desired functions together with general knowledge in the general software and computer arts. It is also known that conventional or specified document handling functions and controls may be alternatively conventionally provided utilizing various other known or suitable logic or switching systems.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below.

The present invention will be better understood by reference to this description of this embodiment thereof, including the drawing figures (approximately to scale), wherein.

Figure 1:
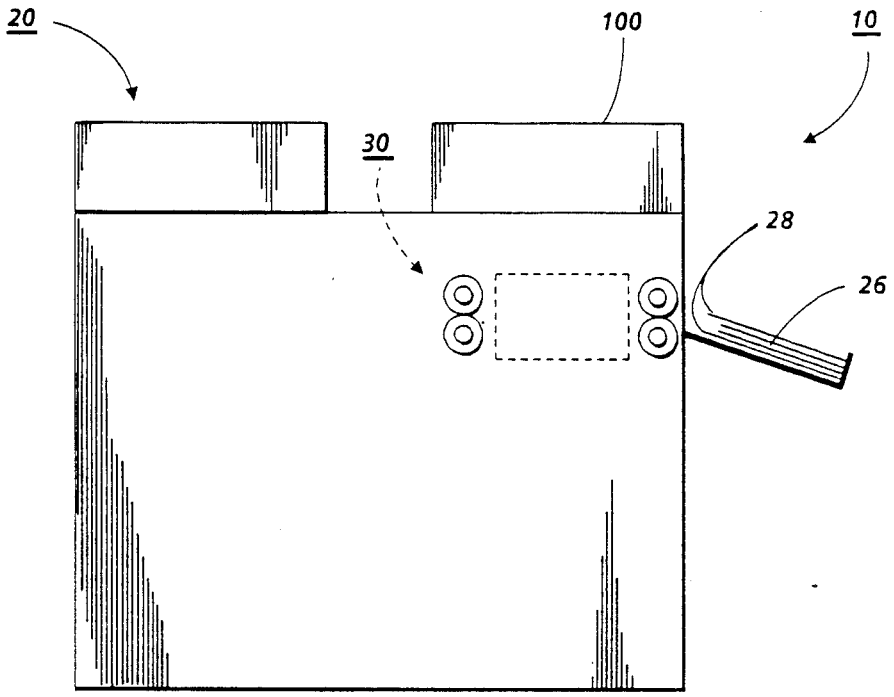
FIG. 1 is a schematic frontal view of an exemplary copier incorporating one example of the subject on-line tab cutting system.
Figure 4:
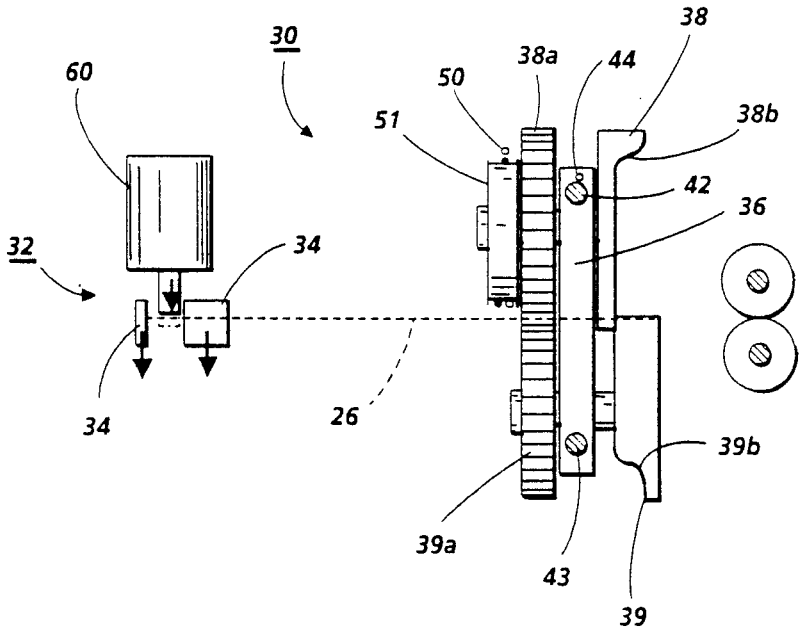
FIG. 4 is a side or frontal view of the system of FIGS. 1–3.
Figure 2:
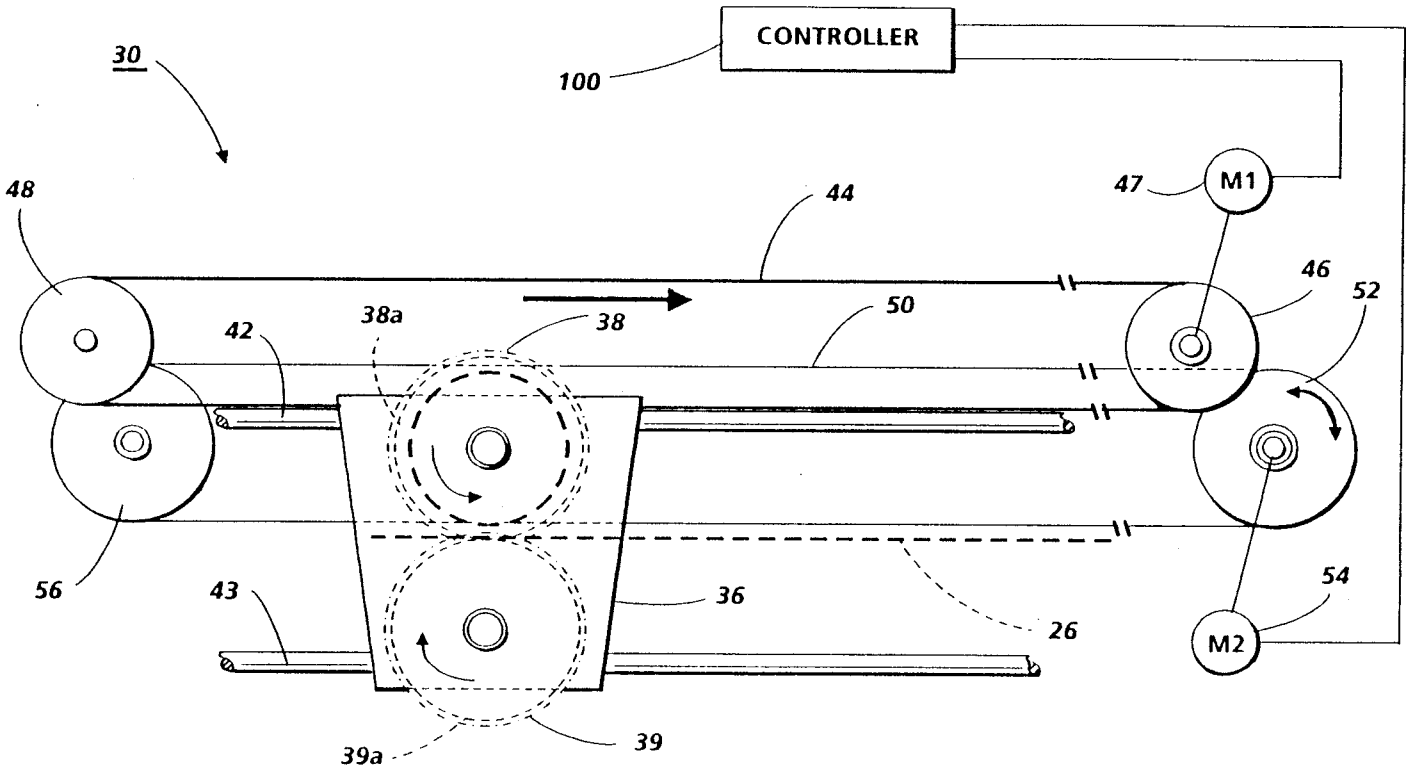
FIG. 2 is an enlarged detailed end view, transverse the copy sheet paper path, of the said exemplary tab cutting system; (for drawing clarity the slitting wheels are shown as phantom diameters on this view)
Figure 3:
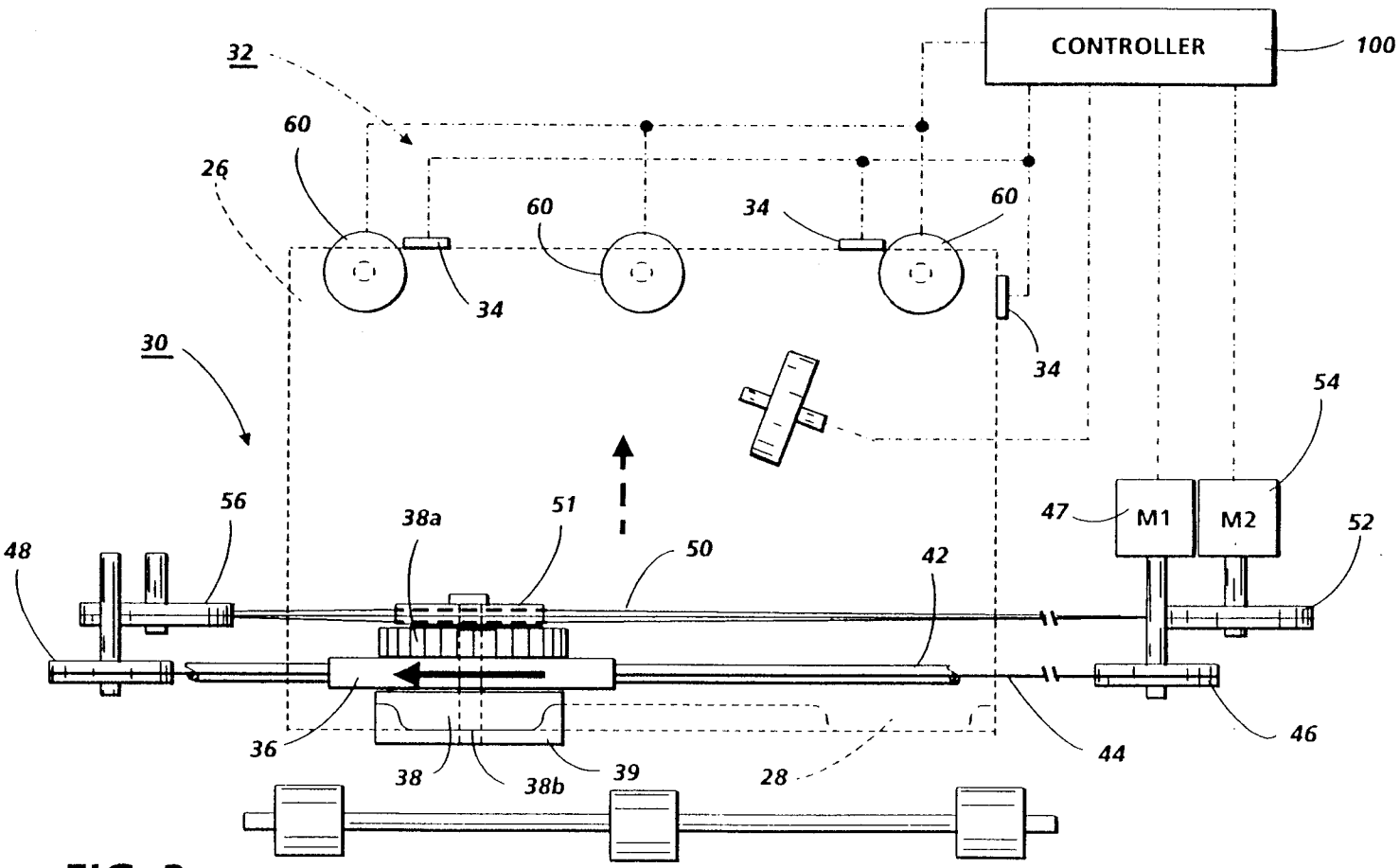
FIG. 3 is a top view of the system of FIGS. 1 and 2.

Describing now in further detail the specific example illustrated in the Figures, there is schematically shown in FIG. 1 an exemplary copier 10, with an exemplary document handler (DH) 20. Preferably the DH 20 is a plural mode recirculating document handler (RDH), or an automatic document stack feeder (ADF). The exemplary copier 10 and DH 20 may be of various known types, such as those disclosed in above-cited patents. The RDH 20 provides for automatically transporting individual registered and spaced document sheets onto and over the imaging station of the copier 10. As is conventionally practiced, the entire document handler unit 20 may pivotally mount to the copier so as to be liftable by the operator up away from the platen for manual document placement and copying.

Other than the modifications and other features to be described herein, the exemplary copier 10 may be, for example, the well known "Xerox" "1075" or "1090" or any other xerographic or other copier, as illustrated and described in various patents cited above and otherwise, including U.S. Pat. No. 4,278,344 and others. Such a copier 10 is preferably adapted in a known manner to provide duplex or simplex precollated or postcollated copy sets from either duplex or simplex original documents copied from the RDH 20.

The control of all sheet feeding is, conventionally, by the machine controller 100. The controller 100 is preferably a known programmable microprocessor, exemplified by the previously cited art. The controller 100 conventionally controls all of the machine steps and functions described herein including the operation of the document feeder 20, the document and copy sheet gates, the feeder drives, etc.. As further taught in those references, the controller 100 also conventionally provides for storage and comparison of the counts of the copy sheets, the number of documents recirculated in a document set, the desired number of copy sets and other selections by the operator through the panel of switches thereon, time delays, jam correction control, etc.. The controller 100 may be conventionally connected to receive jam and control signals from various conventional sheet sensors.

In the copier 10, there are provided automatically tabbed sheets automatically intermixed at selected positions within the stream of output copy sheets of the copier, with an integral, on-line, modular copy sheet tab generating system 30, as will be discussed herein, and as shown in the Figures. The tab cutting system 30 here does not interfere with or interrupt normal copying operations. A selected tab may be cut on a selected sheet being fed through the regular copy sheet (paper) path of the copier 10. The tab cutting system 30 here further has the capability of automatically varying the tab cutting position and the cut tab size to provide varied tabs.

Tab cutting is done here by temporarily stopping and registering the leading edge of the selected sheet, and then shear cutting off the untabed areas of the trailing edge of the sheet by moving an shear cutting assembly transversely across the direction of movement of the copy sheet path of the copier upstream of the lead edge registration position at slightly less than the sheet width distance, and providing irregular width cutting of the sheet (preferably by providing non-cutting of the tab area). The non-cutting of the tab area, and the rounded transitional edges of the tab, may be provided by a tab interruption or offset (special shape) of mating tab cutting shear wheels on the shear cutting assembly, and this may be variably repositioned to change the tab position. The tab cutting system 30 may be conventionally controlled by the controller 100.

Any selected copy sheet 26 may be cut to form a copy sheet tab 28 with the disclosed tab generating system 30. Preferably the tab generating system 30 is a modular unit mounting at an appropriate position within the copier, replacing a portion of the conventional copy sheet path, and forming a part thereof. It is shown here in FIG. 1 in the output path of the copy sheets. When tab cutting is not being provided, the copy sheets may simply pass directly through the tab generating module 30 without being affected. Alternatively, a bypass may be provided, or the tab generating module 30 itself may be offset in a bypass portion of the output path, into which selected copy sheets may be diverted for tabbing. In either case, the copy sheet which has been tabbed is immediately reinserted in its proper order directly into the stream of output copy sheets in the output path of the copier. Thus its collation is maintained, and copying of either the tab sheets or the intermediate copy sheets (in between the tab sheets) is not adversely affected.

The tab generating system 30 here preferably includes a sheet registration system 32 for briefly stopping and registering the copy sheet 26 which has been selected for tabbing. Here, this comprises registration fingers 34. The fingers 34 may be of a known type used in copy sheet registration paths for other purposes (e.g., pretransfer copy sheet registration). The fingers 34 are extended into the copy sheet path by solenoid or other conventional actuation, and the lead edge of the copy sheet 26 will strike these registration fingers and be stopped and aligned, at a tabbing registration position at the fingers. Note that this stopping position is not the conventional registration position in a copier. This is a special position for the tab generating system 30.

Upstream from the registration fingers 30 by approximately (slightly less than) the width of the sheet, i.e., the sheet dimension in its movement direction in the copy sheet path, is a tab cutter transport carriage 36. The carriage 36 mounted for movement along a pair of slide rails 42, 43, as shown. The rails 42, 43 extend transversely across the copy sheet path in this position, so that the carriage 36 will slide thereon transversely across the sheet path. An upper tab cutting wheel 38 is mounted for rotation on the carriage 36 above the sheet path, but with an outside diameter extending slightly into the copy sheet path. A mating lower tab cutting wheel 39 is also mounted to the carriage 36, but below the copy sheet path, and extending upwards through the copy sheet path to slightly overlap and provide sheer cutting in a generally known manner with the cutting edge of the upper tab cutting wheel 38. Respective gears **38*a* and 39*a* mounted concentrically to the two tab cutting wheels 38 and 39**, and mating with one another, can be provided to insure opposite but equal and synchronous rotation of the two cutting wheels with one another irrespective of their other combined movements.

The cutting edge of the upper cutting wheel 38 has a tab cutting interruption **38*b*. The lower tab cutting wheel 39 has a mating corresponding tab cutting interruption 39*b*. This mutual tab cutting interruption moves the cutting line downstream from the rest of the otherwise linear cutting line provided by these two mating shearing wheels. These interruption 38*b* and 39*b* are special shapes which provide the curved, smooth transitional edges of the tabs, and extend axially out, (downstream), to a point beyond the width of a normal copy sheet 26 stopped by the registration system 32. Thus, the copy sheet 26 is not cut by the central portion of this mating interruption cutting edge 38*b* and 39*b*. The principal, cylindrical, portions of the cutting edges of the wheels 38 and 39 cut off a thin, linear, rear edge portion of all of the copy sheet 26 except at the interruption areas 38*b* and 39*b*. If the copy sheet 26 is a conventional 8½" by 11" sheet, the tab may be left flush with the outer edge of the other copy sheets by being left at 8½" while the rest of that tabbed copy sheet 26** trailing edge will be cut to, say, approximately 8". If a 9" by 11" or 9" by 14" copy sheet is utilized, the copy sheet may be cut too so that only the tab will project, by approximately ½" from the other copy sheets in the copy set, and the rest of the tabbed sheet may be trimmed flush with the rest of the copy sheet set, if the shearing wheel cutting edges are re-set 8½" from the registration fingers, or vice versa.

As noted, both of the cutting wheels 38 and 39, and their integral gears **38*a* and 39*a*, are mounted on the cutter transport carriage 36 which slides along two slide rails 42 and 43. Here, the carriage 36 is driven along the slide rails 42, 43 by a connecting, endless loop, drive cable 44. In this example, the drive cable 44 extends between, in a continuous loop around, a drive wheel 46 (driven by a drive motor 47) at one side of the copy sheet path, and an idler wheel pulley 48** at the opposite side of the copy path.

The drive cable 44 movement of the carriage 36 by actuation of the drive motor 47 M1 also impels the rotational drive of the cutting wheels 38 and 39 in this embodiment. Here this rotation is provided from the carriage movement by a base cable 50 which is wrapped once around a drive pulley 51 fixed on the shaft of the upper cutting wheel 38. This non-slip wrap begins and ends at the bottom of the pulley 51. The base cable 50 rotates the drive pulley 51 as the pulley 51 moves with carriage 36 relative to the base cable 50, which is normally held stationary.

However, the base cable 50 is repositionable by means of an indexing wheel 52 driven by an indexing drive 54 (preferably a servo motor M2). The opposite end of the endless loop base cable 50 is supported at the opposite side of the paper path by an idler wheel pulley 56. It may be seen that rotation of M2 indexing drive 54 will rotate the upper tab cutting wheel 38, and through gears **38*a* and 39*a* correspondingly rotate the lower tab cutting wheel 39, irrespective of the movement of the carriage 36 by drive cable 44. This is utilized to provide variable positioning and/or variable width of the tabs 28, by changing the position at which the tab cutter interruptions 38*b* and 39*b* engage the copy sheet during the transverse movement of the cutting wheels across the trail edge of the sheet (by the movement of the carriage 36 by the separate M1 drive motor 47). Preferably this selected tab cutting position is preset by prerotating the cutting wheels 38 and 39 with indexing servo M2 54 incremental movement while the carriage 36 is off on one side of the copy path, i.e., before the tab cutting is started for that copy sheet. By making the effective diameter of the cutting wheels correspond to a normal maximum copy sheet length, e.g., $14'' \div \pi$ $(3.1416) = 4.46''$, one tab cutting interruption 38*b*, 39*b* will provide one tab along the edge of the copy sheet in one pass of the carriage 36, and the position of the tab may be preset and predetermined very simply by the circumferencial starting position to which the cutting wheels are rotated by indexing drive 54 before cutting is started relative to the position of the tab interruption 38*b*, 39*b*. If the base cable 50** is indexed after each pass of the cutting wheels, the position at which a tab is cut on the paper can be correspondingly varied by that amount of indexing for each copy sheet being tabbed.

It may also be seen that if the base cable 50 remains stationary during operation, by halting of the indexing drive 54 during cutting, that the surface speed of the cutting wheels will be synchronized relative to the paper being cut, i.e., the shearing wheels will rotate along the paper as they are cutting without slippage. The synchronization of the cutting line of the two cutters with the copy sheet surface so that the cutters effectively roll over the copy sheet without either pushing or pulling on it may be provided by making the radius of the base cable pulley 51 correspond to the radius from the common center of the common shaft to the plane of the copy sheet.

To make longer (wider) tabs, the rotation of the cutting wheels may be halted intermediately of the tab forming that is, stopped intermediately of the intermeshing of the interruptions **38*b*, 39*b*, by movement of the base cable 50 in a direction opposite to the movement of the drive cable 44**.

The number and size of the tabs is also of course determined by the width of the tab cutting wheel interruptions **38*b*, 39*b***. For example, if this is approximately 1/5 of the cutting wheel circumference, and the cutting wheel circumference corresponds to the document length, then a tab in fifths will be provided in a selected position occupying and extending from approximately 1/5 of the trail edge of the copy sheet.

The shearing type tab generating system 30 provided herein has significant advantages over various other paper cutting systems such as die cutters or choppers. Besides a cleaner cut, and self-sharpening cutting edges, a smaller and less costly cutter can be provided. A large cutting edge does not have to be mounted across the entire cutting path. The present system provides more flexibility in both the position and size of the tabs being cut. They can be varied automatically and selectively merely with electrical inputs from the copier controller. In contrast a shear type tab cutter would require a mechanism for changing or removing teeth corresponding to the tabs in order to accomplish this, and would thus be much more costly and less automatic.

A conventional shaft position switch (not shown), conventionally operated by a cam on a cutter shaft may be provided to indicate a rotational home or start position of the cutter wheels.

Flat metal spring surfaces (not shown) may be fastened inside the cutter wheels, flush with and extending from the tabing transitions **38*b*, 39*b*** edges to help hold and prevent bending of tab being formed.

An additional feature which may be provided, utilizing the same sheet registration system 32, is an on-line hole punch system 60. This may utilize conventional solenoid or cam actuated hole punches to put 3-ring (3 hole) or multi-ring holes in the copy sheet as it is stopped by the same registration fingers 34. As illustrated, these holes may be punched at the appropriate positions in the copy sheet, here near the leading edge of the copy sheet, so as to be appropriately opposite from the tab side of a tabbed copy sheet. This may be done simultaneously with the tab cutting.

It will be appreciated that the selective tab cutting provided as described here in may be automatically coordinated by the controller 100 with the type and order of documents presented for copying by the RDH 20 and copied in the connecting copier processor to provide precollated output copy sets with integral and appropriately variably positioned tabs. This programming can be preselected on the copier controller by the operator, by the console switches or by special job programing insert sheets or cards coded to provide the tabbed insert sheet in the appropriate copy positions. The automatically cut tab sheets are automatically inserted in their desired positions within the sheets of the copy sets without interfering with the copying or finishing operations. Thus the finished (bound) copy sets may be automatically provided with a conventional tab array of sequentially latteraly offset tab dividers within the copy set directly at the copier output without requiring separate processing. These tab sheets may be fed continuously into the copy stream and on into the finisher for appropriate binding by the finisher without interfering with the finisher operation or requiring any modification thereof. This is particularly assisted by the fact that the critical leading edge of the copy sheet is unaffected in this tabbing operation, so that downstream jam sensors and gates are not affected. Also, the tabs are less likely to bend, fold over, or cause jams because they are on the trailing edges of the sheets, and being pulled rather than pushed.

Preferably the tab labels are printed on the copy sheets by the copier in the same copying operation. As noted in the cited references, this can be done by utilizing a document image for the tabs which is printed along one side edge of the copy sheets to be tab cut. Margin shift copying can be used. A common, plural title, document image can be used, since the unselected tab titles may be cut off in the tab cutting operation.

The tab formation and tab sheet inserts can also be automatically tied by the controller 100 to suitable "chapterization" of the subsets of copy sheets in between the tabbed sheets. That is, automatically providing, in a known manner, the beginning of a subset on the facing page immediately following the tab insert sheet, so that the tab sheets form the beginning of chapters without inappropriately positioned blank copy sheet pages in the case of duplex copies. An example of "chapterization" is described in U.S. Pat. No. 4,640,607 issued Feb. 3, 1987 to Richard L. Bray (Eastman Kodak Company).

It will be appreciated that if the copier were of the type in which copy sheets are processed through the copier short edge first, i.e., lengthwise, that the tabs may be cut along one side of the copy sheet in the direction of the paper path, and therefore stopping of the copy sheet would not be required during cutting of the tabs. However, it is well known that this type of copier is not suitable for high-speed copier operation. Feeding the copy sheet long edge first (widthwise) is greatly preferred, because it substantially reduces the copy sheet pitch imaging distance required per copy, and thereby increases the number of copies per minute which can be produced by a copier for a given imaging surface and paper path velocity.

For a high-speed copier it will be appreciated that the movement of the cutting wheel carriage across the copy sheet path must be quite rapid. The sheet stopping and registering and cutting must all occur in, e.g., about 0.3 seconds at 150 copies per minute, in order to avoid skipping more than one copying pitch, or shingling or otherwise stacking up copy sheets. But even in a copier of this speed, the tab cutting operation would require only one skipped pitch in order to provide this cycle time.

As noted, it is also possible to divert subsequent copy sheets not being tabbed around the tabbing module while tabbing is being provided. This of course will alter the sequence of copy sheets when the tab sheet is reinserted into the path behind the bypassed copy sheets, but this can be compensated for by programming in the controller.

It will be appreciated that although there are preferably two mating cutting wheels 38 and 39, as illustrated here, that the lower cutting wheel 39 can be replaced by a sharp edged planer steel surface plate mating in the same manner, if desired. In that case, it may also be desireable to provide clamping of the sheet while it is being cut to hold it in position on the cutting surface. One example of a brake or stop for a cutter is illustrated in U.S. Pat. No. 3,882,744 issued May 13, 1975 to Allen F. McCarroll.

A tab cutting system may alternatively be provided as an input device to the copier, i.e., in the copy sheet path before the copier processing or printing, rather than in the output path. That is, the tab cutter may be placed on line with a copy sheet bin or paper tray/feeder, so as to feed in variably pretabbed but blank copy sheets into the main copier handling module. This would allow the tab cutter to operate more slowly, since the tab stop could be precut before it is needed to be fed into the copy path. This may be implemented here because of the tab being provided on the trailing edge of the document so as not to interfere with the copy sheet registration required for copying.

In either case, by selectably providing tabs on line, directly associated with the copier, the number of dedicated sheet trays needed to provide the tab insert sheets can be greatly reduced. Only one set of tab sheets may be required, fed from only one tray, unless different colors or materials are required for the different tab sheets.

The system disclosed herein is suitable for on-line high-speed operation at substantially the full copying rate of a high-speed copier, and with a very small and compact unit. With this system, tabs may be accurately registered and cut smoothly, and easily varied.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a copier providing a stream of copy sheets in a copy sheet path, the improvement comprising:

sheet selecting and stopping means, for selecting a selected said output copy sheet to be tabbed, and for temporarily stopping said selected copy sheet within said copier at a tabbing registration position within said copier for tab cutting; and tab cutting means in said copier for cutting an edge of said selected copy sheet transversely of said output copy sheet path to form a selected tab on said selected copy sheet while said copy sheet is temporarily stopped by said sheet selecting and stopping means, and then releasing said tabbed copy sheet into said copy sheet path.

2. The copier with tab cutting means of claim 1, wherein said tab cutting means comprises rotatable slitting wheels mounted on a carriage movable transversely of said copy sheet path;

said rotatable slitting wheels having mating cutting edges shaped to cut a tab in the copy sheet by rotation of said rotatable slitting wheels as said carriage is moved transversely of said copy sheet path.

3. The copier with tab cutting means of claim 1, wherein said tab cutting means is selectably variably operable to form variable position tabs on said copy sheet.

4. The copier with tab cutting means of claim 1, wherein said tab cutting means is selectably variably operable to form variable size tabs on said copy sheet.

5. The copier with tab cutting means of claim 2, wherein said tab cutting means is selectably variably operable by changing the rotation of said rotatable slitting wheels to form variable position and variable size tabs on said copy sheet.

6. The copier with tab cutting means of claim 2, wherein said tab cutting means rotatable slitting wheels mating cutting edges have a tab shaped non-cutting position extending upsteam in said copy sheet path.

7. The copier with tab cutting means of claim 1, wherein said tab cutting means is positioned downstream of said tabbing registration position in said copy sheet path by approximately the sheet width of said copy sheet to engage the trail edge of a copy sheet when the lead edge of a copy sheet is being temporarily stopped by said sheet selecting and stopping means.

8. The copier with tab cutting means of claim 2, wherein said carriage movable transversely of said copy sheet path is positioned downstream of said tabbing registration position in said copy sheet path by approximately the width of said copy sheet, so that said rotatable slitting wheels mating cutting edges cut off all but the selected tab area of the trail edge of the copy sheet when the lead edge of the copy sheet is being temporarily stopped by said sheet selecting and stopping means as said carriage is moved transversely of said output copy sheet path.

9. In a method of copying providing a stream of output copy sheets with tabbed insert sheets from a copy sheet path of a copier, the improvement comprising the steps of:

selecting one said copy sheet at a time to be tabbed, and temporarily stopping the leading edge of the selected copy sheet in said copy sheet path at a tabbing registration position; and tab cutting the opposing, trailing, edge of said selected copy sheet transversely of said output copy sheet path to form a selected tab on the trailing edge of said selected copy sheet while said copy sheet is temporarily stopped;

and then releasing said tabbed copy sheet into said copy sheet path again;

and repeating said steps for subsequent selected copy sheets selected out of said stream of copy sheets.

10. The method of copying with tab cutting of claim 9, wherein said tab cutting comprises both moving and rotating a slitting wheel transversely of said copy sheet path, spaced from said tabbing registration position, said slitting wheel having a cutting edge shaped to cut a tab in the copy sheet by rotation of said slitting wheel as said slitting wheel is moved transversely of said copy sheet path.

11. The method of copying with tab cutting of claim 10, wherein said tab cutting is by a pair of mating irregular slitting wheels, and is selectably variably operable by variable rotation of said slitting wheels relative to said copy sheet to form variable position or variable size tabs on said copy sheet.

12. The method of copying with tab cutting of claim 9, further including the step of punching binding holes in said selected copy sheet along the side of said selected copy sheet opposite from said tab cutting and substantially simultaneously with said tab cutting.

* * * * *